US007861946B2

(12) United States Patent
Beeren

(10) Patent No.: US 7,861,946 B2
(45) Date of Patent: Jan. 4, 2011

(54) NOZZLE APPARATUS

(75) Inventor: Joseph M. Beeren, Horst (NL)

(73) Assignee: Deere & Company, Moline, IL (US)

( * ) Notice: Subject to any disclaimer, the term of this patent is extended or adjusted under 35 U.S.C. 154(b) by 203 days.

(21) Appl. No.: 12/146,083

(22) Filed: Jun. 25, 2008

(65) Prior Publication Data

US 2009/0184182 A1 Jul. 23, 2009

Related U.S. Application Data

(62) Division of application No. 11/286,738, filed on Nov. 23, 2005, now abandoned.

(30) Foreign Application Priority Data

Nov. 25, 2004 (DE) ..... 10 2004 056 867

(51) Int. Cl.
*B05B 1/16* (2006.01)

(52) U.S. Cl. ..... 239/170; 239/159; 239/444; 239/551; 239/581.1; 239/67; 137/625.11; 137/883; 137/884

(58) Field of Classification Search ..... 239/124, 239/159, 170, 67, 551, 565, 569, 581.1, 582.1; 137/625.46

See application file for complete search history.

(56) References Cited

U.S. PATENT DOCUMENTS

| | | | | |
|---|---|---|---|---|
| 4,925,097 | A * | 5/1990 | Corrigan | 239/73 |
| 5,400,840 | A * | 3/1995 | Flaherty | 141/384 |
| 5,944,055 | A * | 8/1999 | Dicky | 137/625.47 |
| 5,988,220 | A * | 11/1999 | Sakaki | 137/625.47 |
| 6,189,807 | B1 * | 2/2001 | Miller et al. | 239/124 |
| 6,675,834 | B1 * | 1/2004 | Lai | 137/625.47 |

* cited by examiner

*Primary Examiner*—Dinh Q Nguyen

(57) ABSTRACT

A nozzle apparatus for an agricultural crop sprayer, the apparatus having a control element adjustable using ah external power source for controlling the flow of a spray liquid from a spray line through at least one channel of the nozzle apparatus. Once the control element has been moved to a control position, the position is maintained without further need for external power. The control element may be a ball valve movable to simultaneously select two or more nozzle connections and also to vary flow through the selected nozzle connections.

15 Claims, 9 Drawing Sheets

NOZZLE APPARATUS

This is a divisional application of application Ser. No. 11/286,738 filed 23 Nov. 2005 now abandoned and claims the benefit of the prior application under 35 U.S.C. 121.

FIELD OF THE INVENTION

The invention relates to a nozzle apparatus for a spray machine, such as an agricultural crop sprayer, with an adjustable control element.

BACKGROUND OF THE INVENTION

Agricultural spray machines for outputting a liquid on a crop are known in the prior art. Such spray machines can be embodied as towed sprayers, mounted sprayers, or self-propelled sprayers and have a spray boom fitted with nozzle apparatus. The nozzle apparatus is connected to a spray line and can have one or a plurality of nozzles for outputting the liquid.

FR 2 655 571 A discloses a nozzle apparatus that is connected to a spray line and fitted with a plurality of nozzles that have a manually turnable rapid-change device. Moreover, the nozzle apparatus is provided with a pre-stressed diaphragm valve that opens a line to the nozzle as soon as a corresponding opening pressure is attained in the nozzle apparatus. The problem is that the valve opens only as a function of the spray pressure and the nozzle apparatus thus can only be actuated as a function of the spray pressure in the spray line.

EP 932 448 B1 discloses a nozzle apparatus that has an inlet channel connected to a spray boom and an outlet channel connected to a nozzle. Furthermore, the nozzle apparatus is provided with an electromagnetically switchable valve that connects the channels during a spraying process. The problem is that the valve must be supplied with an electrical switched current during the entire spraying process in order to remain in the connected position.

SUMMARY OF THE INVENTION

The object of the invention is to create a nozzle apparatus of the type cited in the foregoing with which one or more of the aforesaid problems can be overcome.

It is another object of the invention to provide an improved nozzle apparatus for a spray machine, particularly an agricultural crop sprayer, that includes a control element that can be adjusted using an external power source for controlling the flow of a spray liquid from a spray line through at least one channel of said nozzle apparatus so that the control element can be brought into at least two control positions. The control element is so constructed that it remains in the selected control position without external power being supplied.

Advantageous embodiments and further developments of the invention derive from the appended claims.

In accordance with the invention, a nozzle apparatus of the type discussed above is provided with at least one control element that remains in the control positions without external power being supplied. The control element is preferably a control valve and acts to connect, or to interrupt the connection of one or more nozzles of the nozzle apparatus to the spray line of a spray boom. The control element can be brought, switched, moved or actuated into different control positions by an external power. The external power for adjusting the control element is applied automatically in the form of electric, magnetic, pneumatic, or hydraulic energy. The control element is embodied such that as soon as it is brought into an adjustable control position, this adjusted control position is maintained without external power in the form of electric, magnetic, hydraulic, or pneumatic energy having to be supplied to the control element or to adjusting means provided for adjusting the control element. By way of example only, this can occur using frictional engagement between the control element and the nozzle arrangement and/or using self-locking adjusting structure for adjusting the control element. A self-locking adjusting means can, for example, include a spindle joined to the control element. Rotation of the spindle changes the position of the control element but the control element self-locks in position when the spindle is not rotating.

The nozzle apparatus can include a plurality of channels, at least one of which is connected to the spray line of a spray boom. At least one additional channel leads to a nozzle attached to the nozzle apparatus through which nozzle spray liquid can be output. The nozzle apparatus can also be provided with a plurality of identical or different nozzles. In addition, a plurality of channels can also be embodied that lead to one nozzle, or a plurality of channels can be embodied that lead to different nozzles in the nozzle apparatus. By using a plurality of nozzles that are identical and/or different, the spray quantity and/or the shape of the spray stream can be varied and regulated. The control element is arranged between the channel connected to the spray line of the spray machine and at least one channel connected to a nozzle so that the channels are each connectable to one another or separable from one another using the control element. Furthermore, it is conceivable to embody the control element such that control positions can be set in which different channels are connected to a channel leading to a spray line or a plurality of channels leading to one or a plurality of nozzles can simultaneously be connected to a channel leading to a spray line. The advantage of this is that the nozzles connected to the nozzle apparatus can have different output apertures and different nozzles can be automatically selected via the control element. Using appropriate embodiment of the control element, a plurality of the channels can also be connected to one channel that is connected to the spray line. Various switch combinations for the nozzles to one another are conceivable so that for instance the output quantity can be regulated by adjusting the control element in that one or two or more nozzles output spray liquid simultaneously.

It is conceivable that the control positions assumed by the control element also include a control position in which the throughput between two channels can be reduced such that in such a control position only a portion of the stream of liquid is permitted to pass through. Using appropriate control positions between an open and a closed control position, adjustable either continuously or in increments, the throughput of spray liquid as well as the output quantity of spray liquid can be regulated without changing the output cross-section of a nozzle or having to select a different nozzle.

Alternatively or additionally, the control element may be a control valve, in particular as a ball valve, whereby the ball of the ball valve has at least one channel providing a bore through which the channels of the nozzle apparatus can be connected. In this embodiment, the ball is brought into an appropriate control position in which the apertures of the channels in the ball are partially or completely covered by the apertures of the channels of the nozzle apparatus. The ball valve is preferably borne in a ball valve seat embodied by ball cups, whereby the ball valve seat is arranged inside the nozzle apparatus between the channels to be connected. Frictional engagement between the ball wall of the ball valve and the wall of the ball seat maintains a set control position of the ball valve without external power having to be applied. The ball valve can also be provided with a plurality of branched channels or with a plurality of bores whose openings can connect a plurality of channels or a selection of channels to one another. Thus in the ball valve a T-shaped, star-shaped, or even "tripod"-shaped channel connection can be provided to connect a plurality of channels to one another or to separate the channels from one another in a variety of combinations.

In another embodiment of the invention, the control element embodied as a control valve is a reducing valve. A reducing valve in the form of a slide valve is particularly suitable for the reducing valve. Such a reducing valve can have one or a plurality of inputs and outputs that are connected to the channels located in the nozzle apparatus. The channels can be connected to one another and/or separated from one another using appropriate positions of a linearly displaceable slide in the reducing valve housing. Furthermore, intermediate positions are possible in which only a portion of the connecting cross-section of the channels is open or closed. The slide has a certain frictional engagement with the reducing valve housing and/or is joined to a self-locking adjusting means. The slide can have various embodiments. For instance, the slide can be embodied as a disk or plate and can represent a displaceable separating wall between two channels. Furthermore, a reducing valve having a cylindrical slide can also be used in which a pin-shaped slide provided with openings or bores is displaceably borne in a cylindrical reducing valve housing connected to input and output channels. By appropriately regulating the slide position of a reducing valve, an aperture cross-section between two channels can be regulated and thus a regulatable reduction in the throughput can be attained. Furthermore, instead of a slide, the reducing valve can, for instance, have a throttle that closes or opens a throttle space connected to the channels in the nozzle apparatus. The throughput through the throttle space can be regulated by appropriate (intermediate) positions of the throttle. The throttle is preferably joined to a self-locking adjusting structure. Furthermore, it is also conceivable to employ a reducing valve embodied as a mushroom valve. Using the mushroom valve, the throughput between the two channels can be regulated via an adjustable aperture cross-section between valve disc and the valve aperture embodied in a valve housing. The valve disk position can also be adjusted via a self-locking adjusting structure, for instance via a spindle.

The control element can preferably be actuated with a motor. Triggerable electro-motors that are connected to the control element via a spindle are particularly suitable for this actuation. The electro-motor can be a pulse-controlled step motor for example. However, other types of electro-motors that permit fine adjustment of the control element are also conceivable. Where necessary, speed reducers can also be employed for finely adjusting the control element using a rotational or linear movement.

One inventive nozzle apparatuses particularly suitable for use in agricultural crop sprayers. Such sprayers, for instance mounted sprayers, towed sprayers, or even self-propelled sprayers, have a spray boom that extends horizontally to the direction of travel of the sprayer and to the ground. The spray boom carries a spray line that extends along the spray boom. The spray line is fitted with a plurality of nozzle apparatus that are distributed along the spray line across the entire width of the spray boom. The spray line can be a rigid tube that is provided with a plurality of spray line bores through which spray liquid is conducted into the nozzle apparatus. Such a spray boom provided with the inventive nozzle apparatus offers the additional advantage that, due to the embodiment of the nozzle apparatus, each individual nozzle apparatus is controllable and thus a more precise width setting when the spray liquid is output is possible compared to a spray boom for which part of the width is controlled.

The invention, as well as advantages and further advantageous developments and embodiments of the invention, are described and explained in greater detail using the drawings, which depict a number of exemplary embodiments of the invention.

DESCRIPTION OF THE PREFERRED EMBODIMENT

Figure 1:
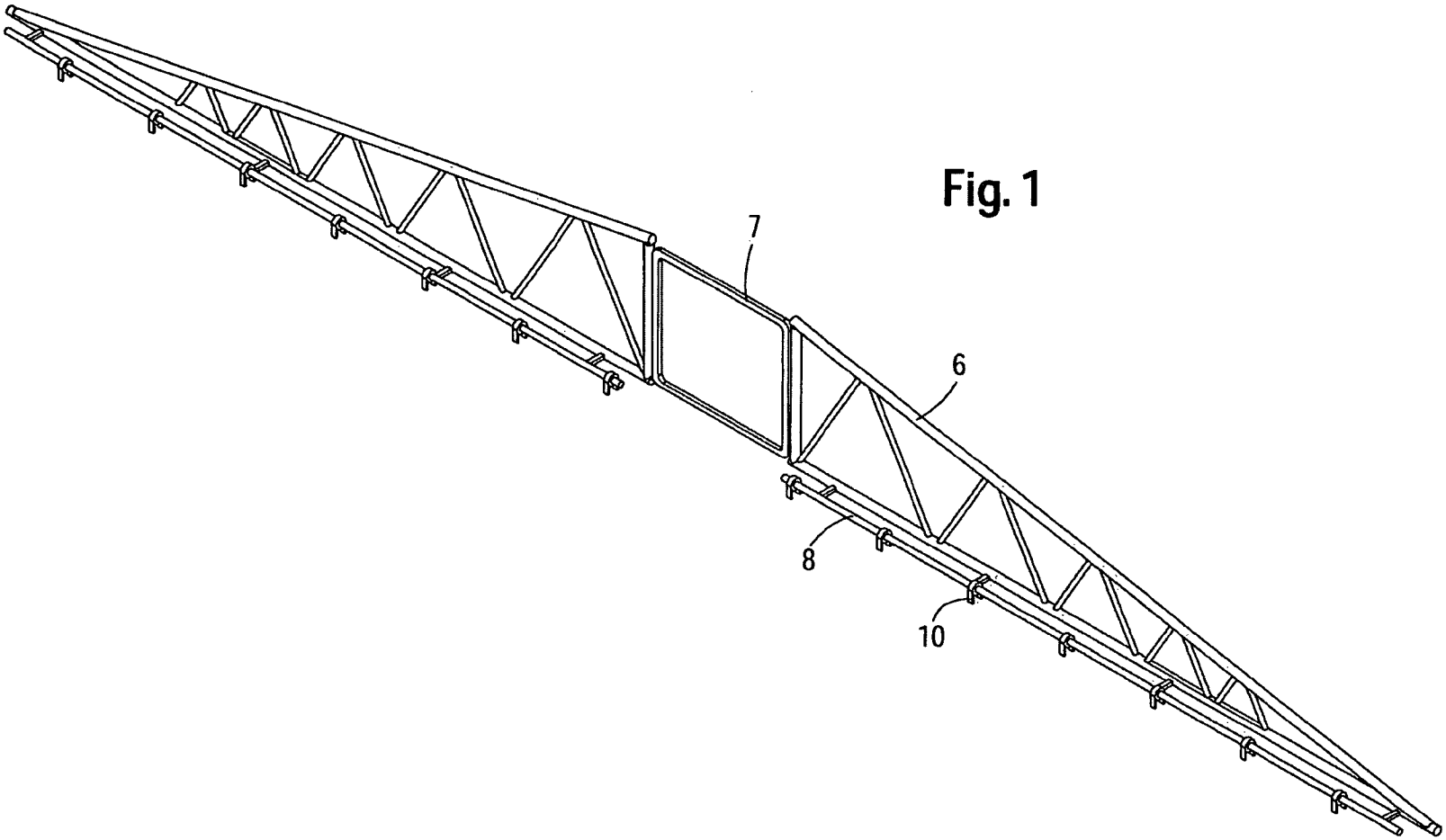
FIG. 1 is a schematic perspective of a spray boom of a spray machine.

FIG. 1 illustrates a spray boom 6 of a spray machine (not shown). Such a spray boom 6 is employed for instance with agricultural crop sprayers, including towed sprayers, mounted sprayers, and self-propelled sprayers. The spray boom 6 includes a mounting frame 7 for attaching the spray boom 6 on the spray machine. The spray boom 6 has a spray line 8 that extends laterally in opposite directions along the spray boom 6. The spray line 8 is fitted with a plurality of nozzle apparatus 10 along the spray boom 6. Each nozzle apparatus 10 is supplied with spray liquid to be sprayed using spray line bores (not shown) in the spray line 8.

Figure 2:
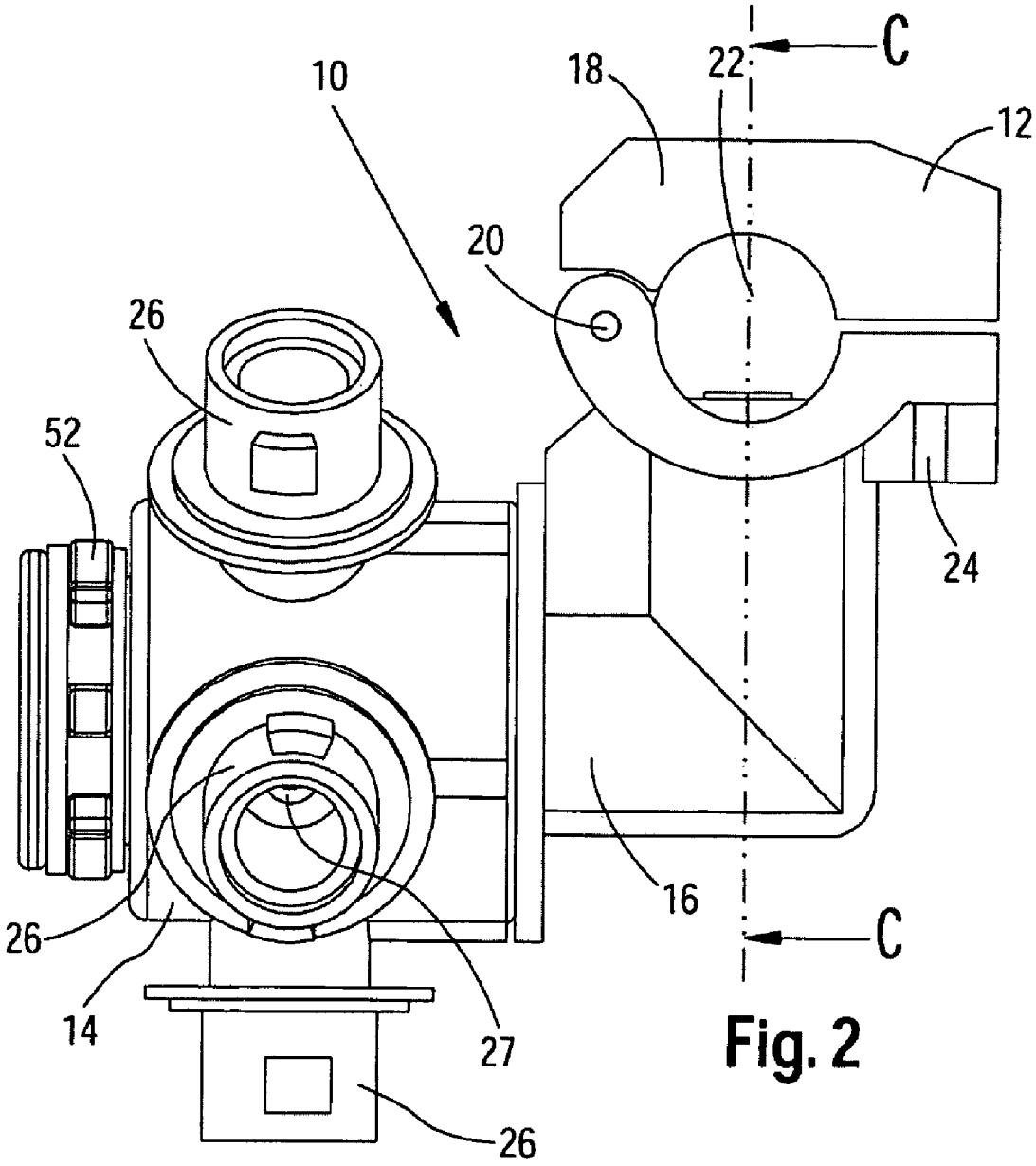
FIG. 2 is a side view of a nozzle apparatus.

FIG. 2 illustrates a nozzle apparatus 10 for a spray machine such as an agricultural crop sprayer. The nozzle apparatus 10 has a fastening part or mounting bracket 12, a nozzle carrier part 14, and a housing part 16. The fastening part 12 has a clip 18 that is connected to the housing part 16 or connected via hinge 20. A circular opening 22 is defined between the clip 18 and the housing part 16. The clip 18 and the housing part 16 can be screwed together With screws (not shown) through bores 24.

The nozzle carrier part 14 is shown as a turret and has a plurality of nozzle connections 26 that are distributed uniformly over the circumference of the nozzle carrier part 14. The nozzle carrier part 14 functions as a sleeve and is rotatably supported on the housing part 16. Inside each nozzle connection 26 a connecting bore 27 leads into the interior of the nozzle carrier part 14.

Figure 3:
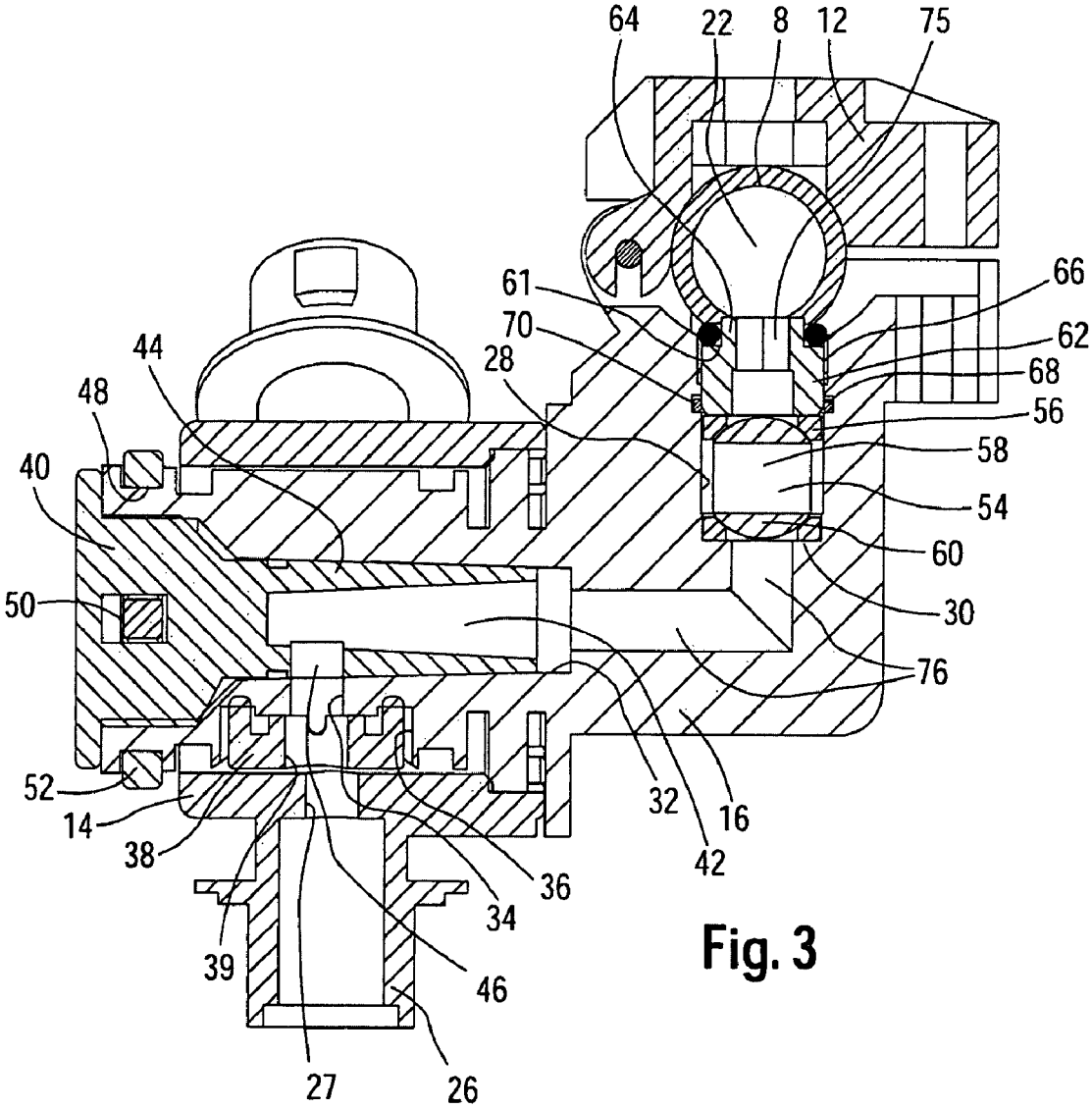
FIG. 3 is a sectional view of the nozzle apparatus in FIG. 1 with a control element in the closed position.

Details of the housing part 16 can be seen particularly well in FIG. 3. The housing part 16 has a first bore 28 that leads starting from the opening 22 vertically into the interior of the housing part 16. A step 30 is formed in the interior of the bore 28 to reduce the diameter of the bore 28. The housing part 16 includes a second bore 32 that, starting from an area on which the nozzle carrier part 14 is rotatably mounted, leads horizontally into the interior of the housing part 16 to a juncture with the bore 28. Located in the area of the nozzle connections 26 is an additional bore 34 that represents a vertical passage through the wall of the housing part 16 into the horizontal bore 32. An opening 36 is provided in the area of the bore 34 on the outside of the housing part 16 in which a ring seal 38 is embedded that is sealingly engaged with the inside of the nozzle carrier part 14 and with the outside of the housing part 16 and is flush with the opening 39 of the bore 34.

A cylindrically shaped connection stopper or plug 40 extends into the end of the bore 32 near the nozzle carrier part 14. The plug 40 has a tube-shaped area 42 with a wall 44 in the area of the nozzle connections 26 and With a through-bore 46. The through-bore 46 is flush with the bore 34 and the aperture 39. The plug 40 is secured on the housing part 16 via annular slot 48 on the housing part 16 and a transverse bore 50 in the annular slot 48 by a keeper or retaining ring 52. The keeper 52 and the annular slot 48 are dimensioned such that the nozzle carrier part 14 is simultaneously secured axially on the housing part 16.

A control element 54 in the form of a ball valve is arranged in the bore 28 at the height of the step 30. The control element 54 has two ball cups 56 embodied as rings that conform to the bore 28. A ball 60 provided with a through-bore 58 is rotatably borne between the ball cups 56. Above the control element 54, a connecting tube 62 provided with a step 61 is fitted in the bore 28. An area 64 having a smaller diameter projects into the hole 22. The step 61 is provided with an annular seal 65. The larger diameter area 66 of the connecting tube 62 engages an annular seal 70 fitted in the wall of the bore 28 in an annular slot 68.

Figure 4:
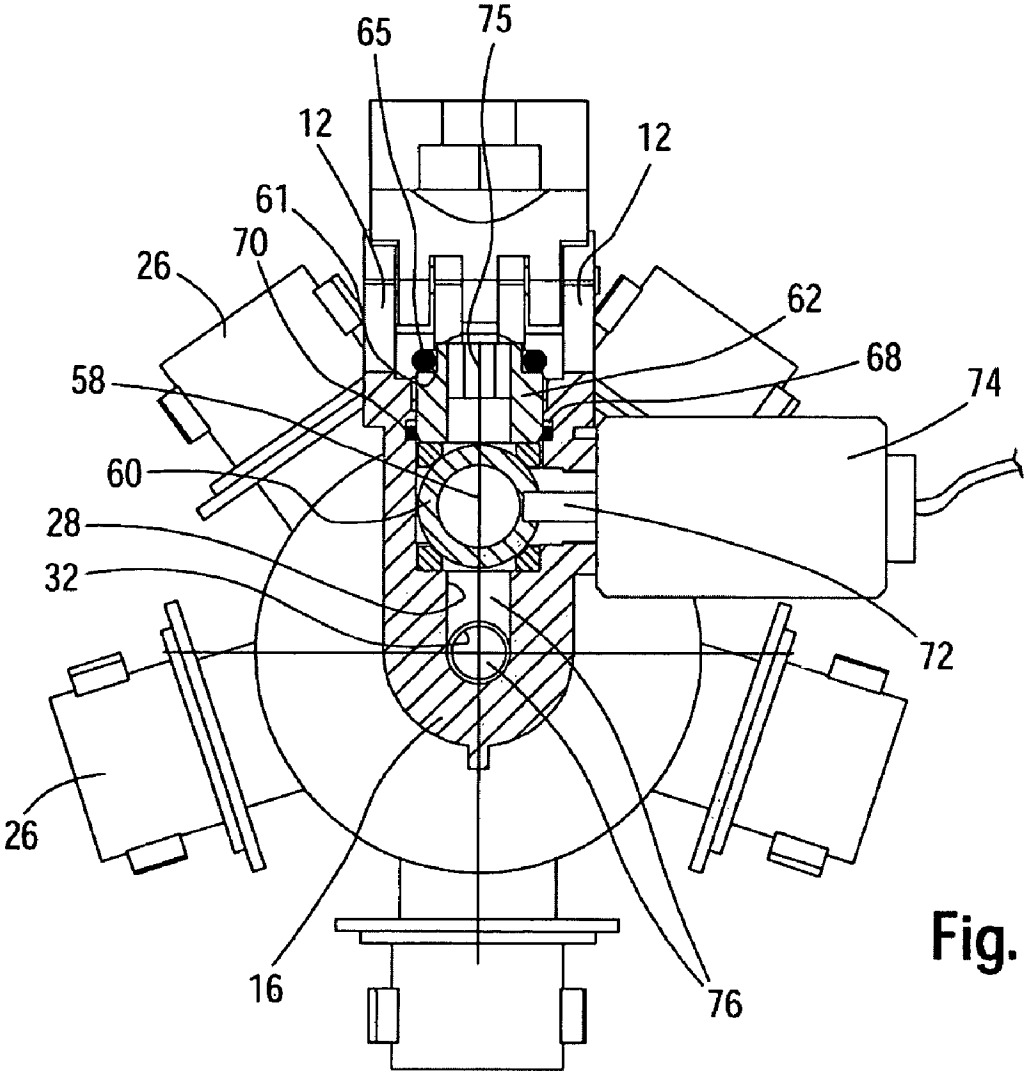
FIG. 4 is another sectional view of the nozzle apparatus in FIG. 1 with the control element in the closed position.

As can be seen in FIG. 4, the ball 60 is securely joined to an adjusting axle or 72 or spindle. The spindle 72 is securely joined to a rotor (not shown) of an adjusting motor 74 such as an electromotor. The adjusting rotor 74 is fixed to the housing part 16 of the nozzle apparatus 10, preferably by bolting to the housing part (not shown).

The nozzle apparatus 10 is attached to the spray line 8 with the fastening part 12. The opening 22 of the nozzle apparatus 10 is placed against the spray line 8 with the area 64 of the connecting tube 62 projecting into a bore (not shown) in the spray line. The annular seal 65 located on a connecting tube 62 prevents the spray liquid from escaping between a spray line bore and the connecting tube 62.

Starting from the opening 22, the hollow space of the connecting tube 62 forms a first channel 75 which conducts spray liquid to the control element 54. In the direction of flow downstream of the control element 54, the remaining portion of the bore 28 and the bore 32 of the housing part 16, the tube-shaped area 42, the bore 46 of the connection stopper 40, and the aperture 39 in the annular seal 38 form a second channel 76. This second channel 76 can be connected to the nozzle connections 26 by aligning the connecting bores 27 with the aperture 39.

In FIGS. 3 and 4, the control element 54 is shown in a closed position. That is, the wall of the ball 60 closes the apertures of the first and second channels 75,76 so that no spray liquid can travel to the nozzle connections.

Figure 5:
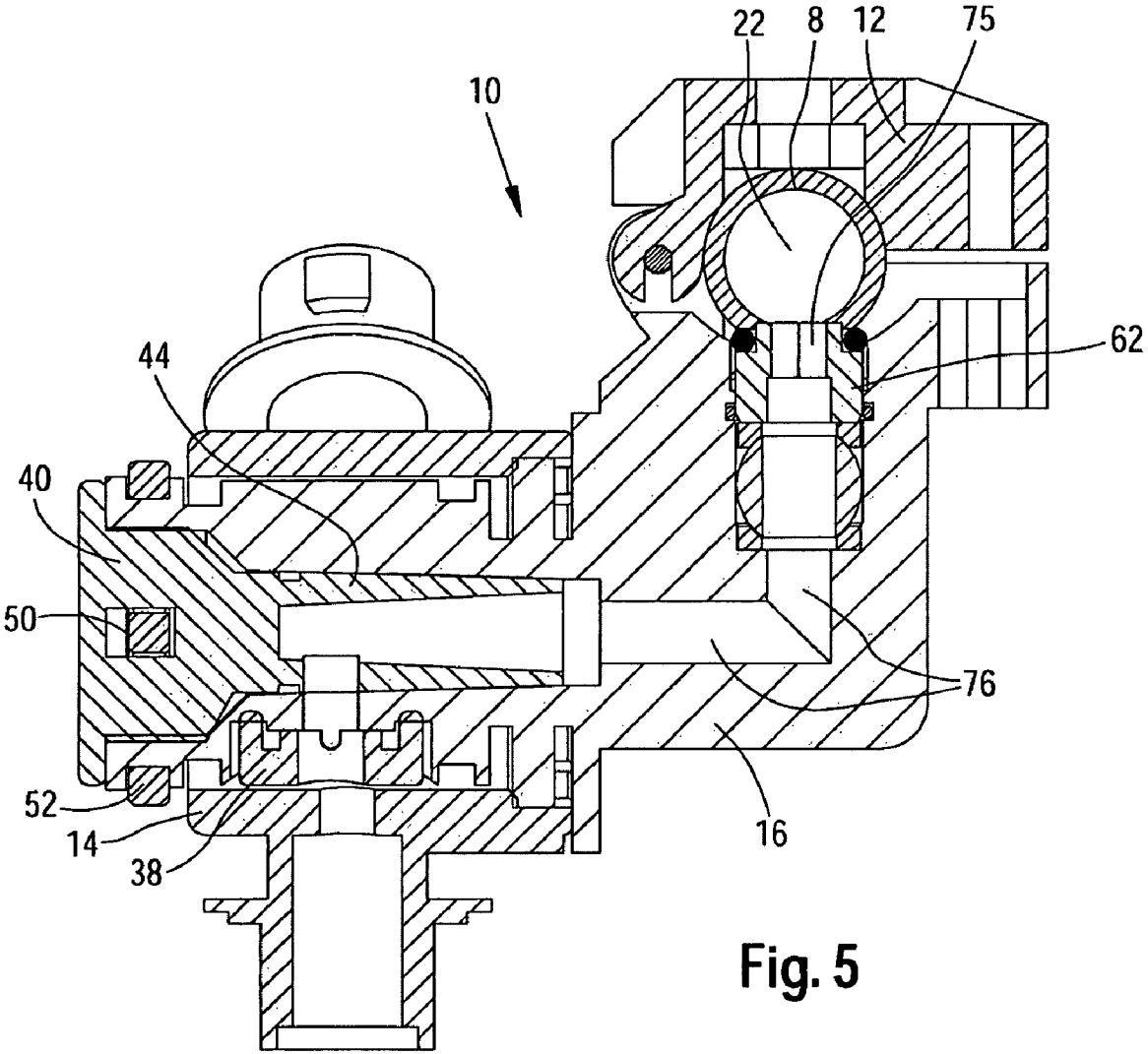
FIG. 5 is the sectional view in accordance with FIG. 2 with the control element in the open position.

For supplying the nozzle connections with spray liquid, the control element 54 (i.e., the ball 60) is turned so the through-bore 58 is brought into alignment with the apertures of the first and second channels 75,76, as shown in FIG. 5. To accomplish aperture and bore alignment, the adjusting motor is appropriately controlled and the adjusting shaft 72 joined to the ball 60 is rotated to the desired position. Depending on the control signal for the adjusting motor, the adjusting element 54 can be brought into a completely open position (see FIG. 3) or even into a partially open position. In a partially open position, the control element 54 is turned less than 90° so that the apertures of the first and second channels 75,76 are only partially opened. Thus a throttle position can be attained that can be used to regulate a throughput quantity of spray liquid.

Figure 6:
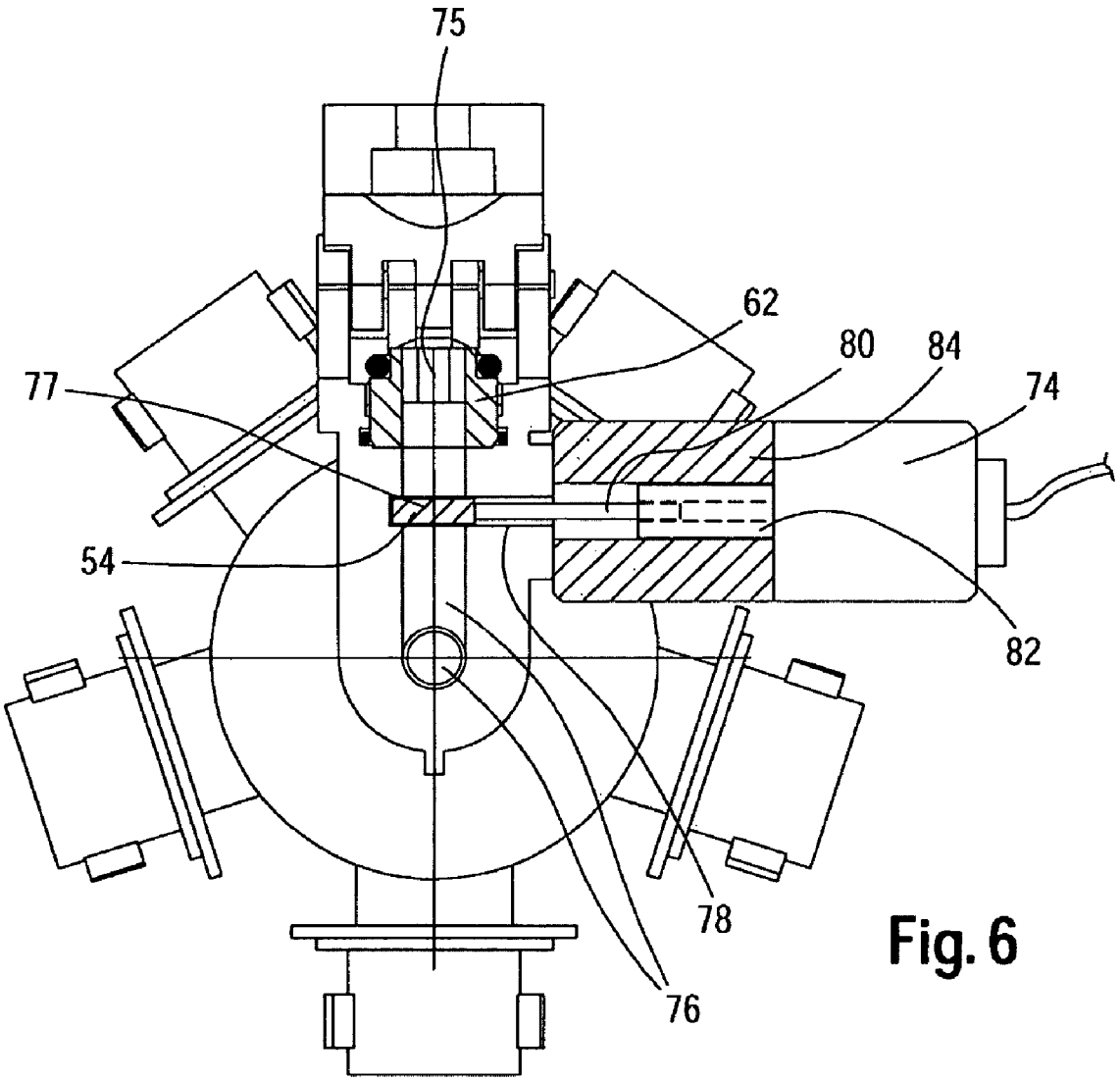
FIG. 6 is a sectional view of the nozzle apparatus with a control element in another embodiment.

FIG. 6 illustrates another exemplary embodiment of the nozzle apparatus 10. The nozzle apparatus 10 has a control element 54 in the form of a slide valve, whereby a slide 77 such as a disc or slide member is movably mounted in a guide 78. The slide 77 is constructed to completely closes the aperture cross sections of the first and second channels 75, 76 in the closed position illustrated in FIG. 6. The slide 77 is securely joined to an adjusting spindle 80 shown as a threaded rod received by a threaded sleeve 82 joined to the adjusting motor 74. The adjusting motor 74 is connected to the housing part 16 of the nozzle apparatus 10 via connecting part 84 having a guide bore 86 for the threaded sleeve 82. The adjusting motor 74 is preferably screwed to the connecting part 84 and/or the connecting part 84 to the housing part 16 (not shown).

By triggering the adjusting motor 74 or by turning the threaded sleeve 82, the slide 77 is displaced inside the guide 78 in its position and the aperture cross-section of the channels 75, 76 are partially or completely uncovered. Thus, depending on the control signal for the adjusting motor 74, a throttle position can be obtained that can be used to regulate a throughput quantity of sprayed liquid.

Figure 7:
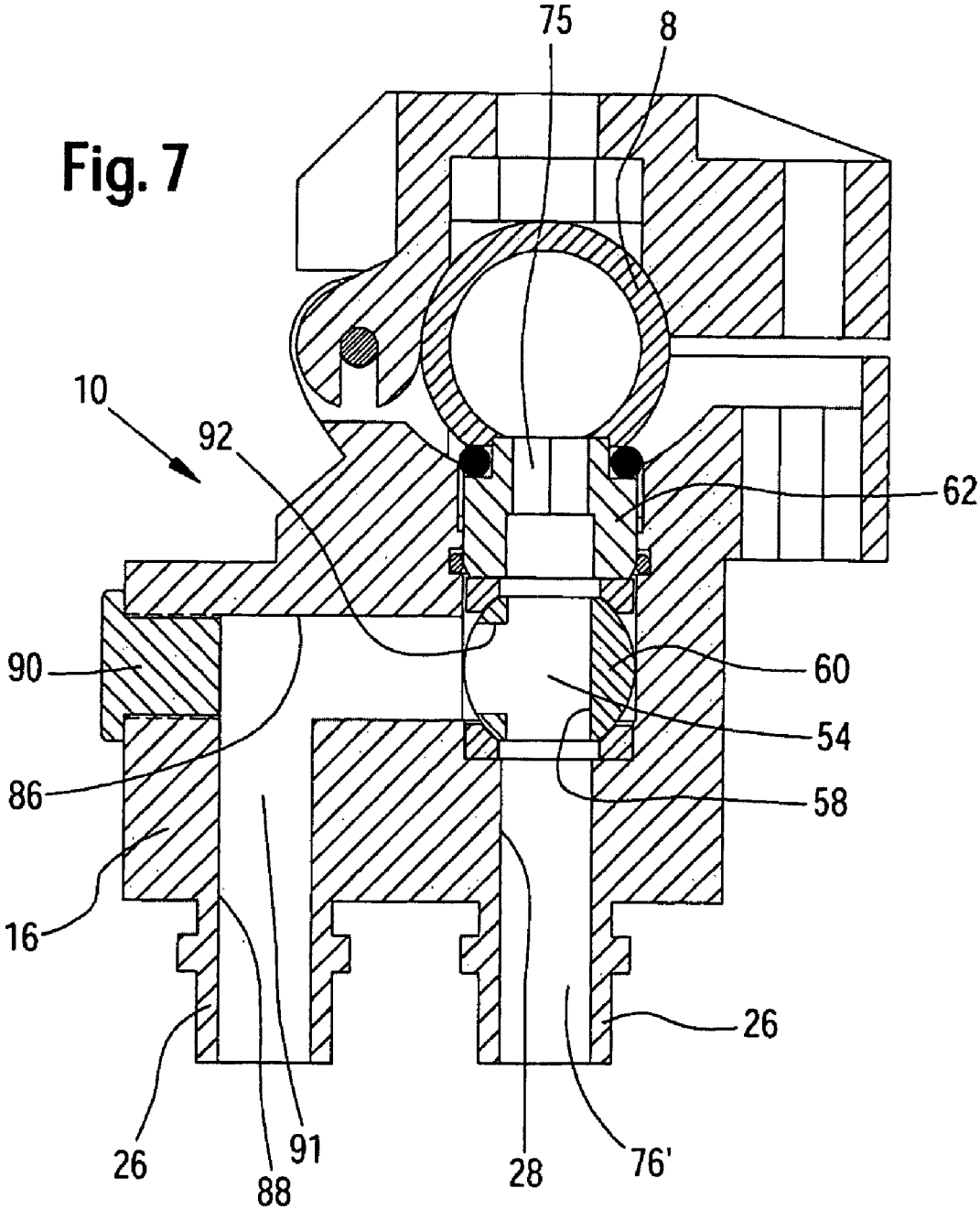
FIG. 7 is a sectional view of another embodiment of a nozzle apparatus.

In another exemplary embodiment depicted in FIG. 7, the housing part 16 is provided directly with nozzle connections 26 and does not have a separate nozzle carrier part 14. Compared to the exemplary embodiments depicted in FIGS. 2 through 6, the housing part 16 has one bore 28 that leads in a straight line to the nozzle connection 26 so that a second channel 76' is formed solely by the bore 28. Moreover, the housing part 16 is provided with an additional horizontally oriented bore 86 and with an additional vertically oriented bore 88, the bore 86 being arranged at the height of the control element 54 and the bore 88 meeting the bore 86 perpendicularly so that the bores 86, 88 form a right angle. Furthermore, a stopper 90 is provided with which the horizontal bore 86 is closed on the side. Using the additional bores 86, 88 together with the stopper 90, a third channel 91 is formed that leads from the control element 54 to a nozzle connection 26. Thus, the nozzle connections 26 are each connected to channels 76', 91, each of which leads separately to the control element 54 in the housing part 16.

The control element 54 is likewise embodied as a ball valve. As shown in FIG. 7, the ball 60 includes, in addition to the through-bore 58, an additional bore 92. The bores 58, 92 are branch relative to one another into a T-shape. The apertures of the channels are arranged according to the bores 58, 92 of the ball 60. By turning the ball 60 into the different control positions, the channels 75, 76', 91 defined in the housing part 16 can be connected to or separated from one another in any desired combination.

The example depicted in FIG. 7 illustrates the connection of all three channels 75, 76', 91 to one another, whereby the first channel 75 is defined by the connecting tube 62, the second channel 76' is defined by the bore 28, and the third channel 91 is defined by the bores 86, 88. Turning the ball 60 clockwise an additional 90° would for instance only connect the third channel 91 to the first channel 75. Turning the ball 60 clockwise an additional 90° would only connect the second channel 76' to the first channel 75. Turning the ball 60 clockwise an additional 90° would connect the second 76' channel to the third channel 91 and would separate both from the first channel 75 so that supply of the spray liquid would be interrupted. The ball 60 is thus triggered in the same manner as is described for the exemplary embodiment in FIGS. 2 through 5. Because triggering the control element 54 can be used to vary the number of channels 76', 91 supplied with spray liquid, and thus the number of nozzles supplied with spray liquid (not shown), the output quantity can also be regulated without changing the outlet cross-section of a nozzle by selecting a nozzle with a larger or smaller outlet cross-section. This is usually associated With manual adjustment of the nozzle carrier part 14. In addition, aperture cross-sections can also be regulated by turning the ball slightly (less than 90° out of a control position) so that it is possible to throttle throughput in this exemplary embodiment as well.

Figure 8:
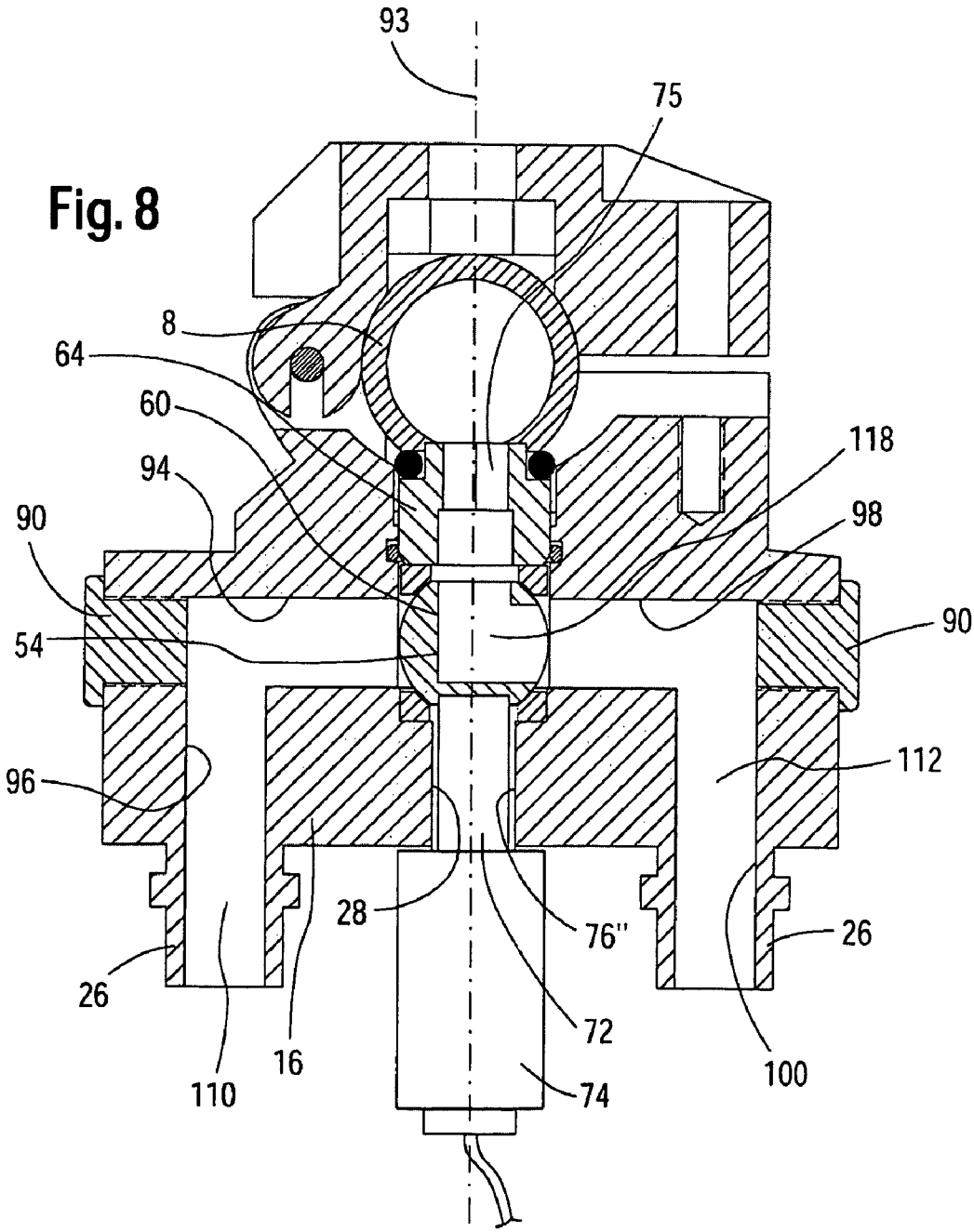
FIG. 8 is a sectional view of another embodiment of a nozzle apparatus.
Figure 9:
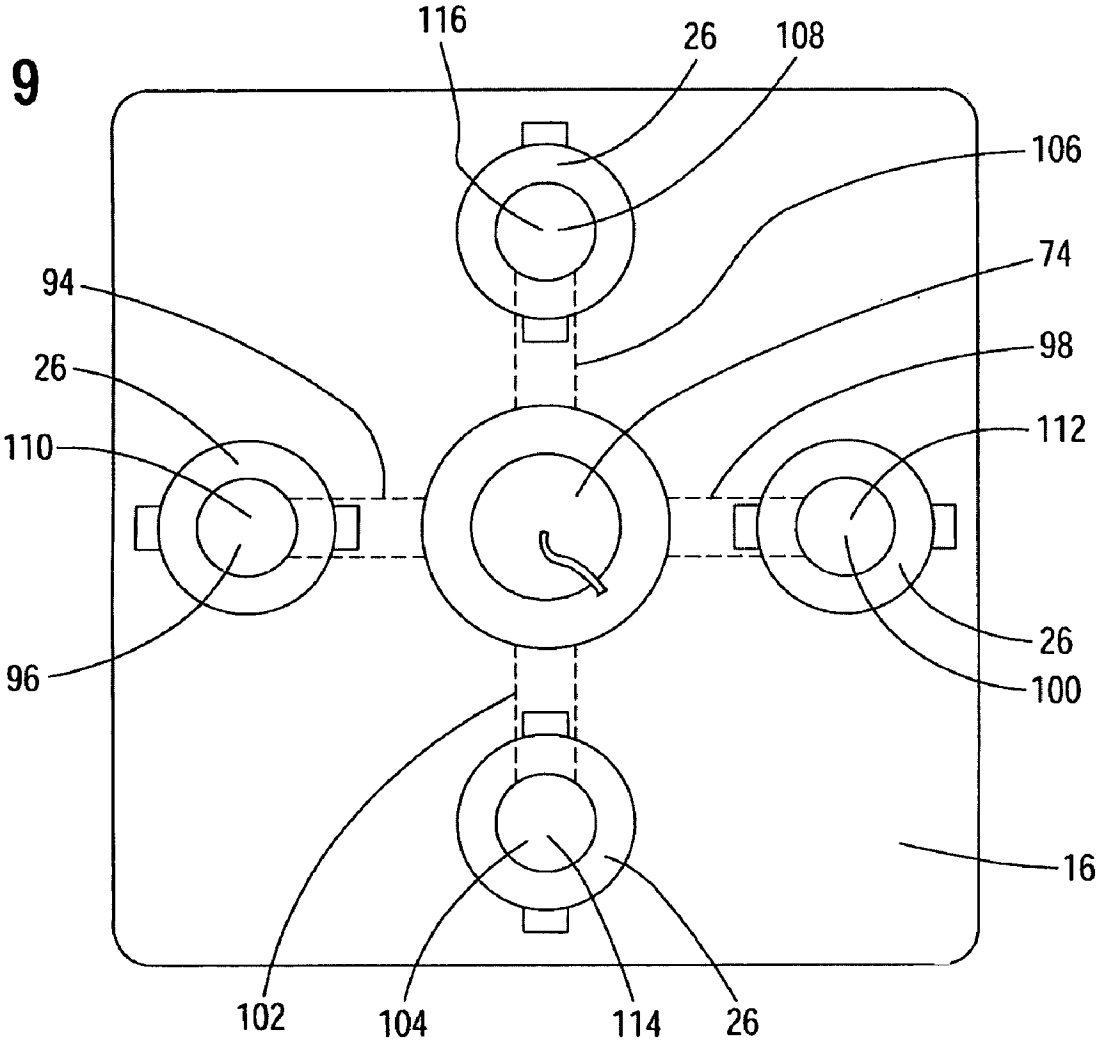
FIG. 9 is a bottom view of the nozzle apparatus in FIG. 7.

In another exemplary embodiment shown in FIGS. 8 and 9, four nozzle connections 26 are arranged uniformly about an axis 93 aligned concentrically with the bore 28. As with the designs in FIG. 7, there is no nozzle carrier part 14 and the housing part 16 includes additional bores 94 through 108. The additional bores 94 through 108 are configured similarly to the bores 87, 88 in FIG. 7. In connection with the stopper 90, this embodies a third, fourth, fifth, and sixth channel 110, 112, 114, 116, each leading from the control element 54 to the nozzle connections 26. In this way, the bores 94, 96 form a third channel 110, the bores 98, 100 form a fourth channel 112, the bores 102, 104 form a fifth channel 114, and the bores 106, 108 form a sixth channel 116 (see also FIG. 9). In this exemplary embodiment, the second channel 76" formed by the bore 28 guides the adjusting axis 72 of the adjusting motor 74. The adjusting motor 74 is arranged below the housing part 16 concentric with the axis 93 and connected via the adjusting axis 72 to the control element 54.

The control element 54 is again embodied as a ball valve, whereby the ball 60 of the control element 54 has an angle bore 118. The angle bore 118 is embodied by two blind bores that meet one another to form a right angle control channel. The angle bore 118 is also constructed such that turning the ball 60 can connect the first channel 75 defined by the connecting tube 62 to the third through sixth channel 110, 112, 114, 116. By appropriately triggering the adjusting motor 74, the ball can be displaced such that either the third channel 110 or the fourth channel 112 or the fifth channel 114 or the sixth channel 116 is connected to the first channel 75. Given an appropriate intermediate position of the ball, the throughput through any of the cited channels 110, 112, 114, 116 can be interrupted and/or reduced. The nozzle connections 26 can be fitted with different nozzles so that it is thus possible to attain a selection of nozzles by turning the ball 60 and/or by triggering the control element 54 using the adjusting motor 74.

All of the illustrated exemplary embodiments have the advantage that, by a embodying the control element 54 in the form of a ball valve or slide valve, it is only necessary to supply current to the adjusting motor 74 for displacing the control element 54. As soon as a control position has been assumed, the control position can be maintained without supplying external power, in this case electrical energy.

Having described the preferred embodiment, it will become apparent that various modifications can be made without departing from the scope of the invention as defined in the accompanying claims.

The invention claimed is:

1. Spray nozzle apparatus for supporting spray nozzles on an agricultural sprayer having a spray line, the spray nozzle apparatus comprising: a housing; nozzle connections attached to the housing for supporting the spray nozzles from the housing; an adjustable control element comprising a ball rotatably mounted in the housing and having a ball channel opening to the spray line for receiving fluid under pressure from the spray line; a plurality of housing channels opening towards the ball and opening into the nozzle connections; a motor connected to the ball for rotating the ball and selectively connecting the ball channel to at least two of the housing channels simultaneously, the ball controllable by the motor to select the housing channels connected to the ball channel for adjusting flow of the fluid to the nozzle connections.

2. The spray nozzle apparatus as set forth in claim 1 wherein the ball is controllable to vary rate of flow from the spray line to the nozzle connections.

3. The spray nozzle apparatus as set forth in claim 1 wherein the nozzle connections are integral with the housing.

4. The spray nozzle apparatus as set forth in claim 1 wherein the ball channel is T-shaped.

5. The spray nozzle apparatus as set forth in claim 1 wherein the ball channel has three openings, one of the openings in fluid communication with the spray line and wherein the remaining openings selectively align with the housing channels.

6. The spray nozzle apparatus as set forth in claim 5 wherein the ball is rotatable to vary rate of flow from the spray line to the housing channels.

7. The spray nozzle apparatus as set forth in claim 5 wherein one of the ball channel openings opens into a bore connected to and extending perpendicularly to one of the housing channels.

8. The spray nozzle apparatus asset forth in claim 1 wherein the housing channels are uniformly arranged about an axis passing through the ball.

9. The spray nozzle apparatus as set forth in claim 8 comprising at least three housing channels opening into the nozzle connections, and wherein the nozzle connections are arranged uniformly about the axis.

10. The spray nozzle apparatus as set forth in claim 8 wherein the housing channels include outward bores extending radially from the ball and the nozzle connections extend perpendicularly to the outward bores.

11. The spray nozzle apparatus as set forth in claim 8 wherein the ball is turnable to vary the throughput from the spray line to the nozzle connections.

12. The spray nozzle apparatus as set forth in claim 8 wherein the housing channels each comprise first and second blind bores connected at a right angle, the first blind bore opening onto the ball and the second blind bore opening to the nozzle connection.

13. The spray nozzle apparatus as set forth in claim 1 wherein the ball channel includes a first opening communicating in a first direction with the spray line and a second opening that opens in a second direction generally perpendicular to the first direction, and wherein the housing channels include a first channel opening in the second direction.

14. The spray nozzle apparatus as set forth in claim 13 including nozzle connections extending perpendicularly to the second direction.

15. The spray nozzle apparatus as set forth in claim 8 wherein the axis passes through the spray line, the ball channel, and the motor.

* * * * *